United States Patent [19]

Duruz

[11] Patent Number: 4,681,671

[45] Date of Patent: Jul. 21, 1987

[54] LOW TEMPERATURE ALUMINA ELECTROLYSIS

[75] Inventor: Jean-Jacques Duruz, Geneva, Switzerland

[73] Assignee: ELTECH Systems Corporation, Boca Raton, Fla.

[21] Appl. No.: 829,435

[22] Filed: Feb. 13, 1986

[30] Foreign Application Priority Data

Feb. 18, 1985 [AT] Austria ..... 810063/85

[51] Int. Cl.[4] ..... C25C 3/06; C25C 3/12

[52] U.S. Cl. ..... 204/67; 204/245

[58] Field of Search ..... 204/67, 245

[56] References Cited

U.S. PATENT DOCUMENTS

| | | | |
|---|---|---|---|
| 3,501,387 | 3/1970 | Love | 204/67 |
| 3,616,439 | 10/1971 | Love | 204/244 |
| 3,951,763 | 4/1976 | Sleppy et al. | 204/67 |
| 4,338,177 | 7/1982 | Withers et al. | 204/243 |
| 4,397,729 | 8/1983 | Duruz et al. | 204/243 |

FOREIGN PATENT DOCUMENTS 0030834 12/1980 European Pat. Off. .

OTHER PUBLICATIONS

"Oxide Solubility in Lithium Chloride-Aluminum Chloride Melts", W. E. Haupin, Aluminum Company of America.

"Bench Scale Electrolysis of Alumina in Sodium—Fluoride—Aluminum Floride Melts Below 900° C." in Aluminum, 1979.9, pp. 604–606.

EP 85810063, European Standard Search Report, dated Nov. 7, 1985 "The Alcoa and Toth Processes of Aluminium Production—Outline and Comparison", K. Grjotheim, C. Krohn and H. A. Oye, Aluminium 51 (1975)11, pp. 697/699.

*Primary Examiner*—John F. Niebling

*Attorney, Agent, or Firm*—John J. Freer

[57] ABSTRACT

A method of producing aluminum by electrolysis of alumina dissolved in molten cryolite at temperature between 680°-690° C. is disclosed. The method comprises the employment of permanent anodes the total surface of which is increased up to 5 times compared to the total surface of anodes in a classical Hall-Heroult cell of comparable production rate. By this means the anodic current density is lowered to a degree which permits the discharge of oxide ions preferentially to fluoride ions at an acceptable rate. Additionally, the electrolyte is circulated by suitable means whereby it passes from an enrichment zone where it is saturated with alumina to an electrolysis zone and back.

20 Claims, 2 Drawing Figures

LOW TEMPERATURE ALUMINA ELECTROLYSIS

TECHNICAL FIELD

The invention relates to a method of producing aluminum by electrolysis of alumina dissolved in a molten fluoride electrolyte in an aluminum reduction cell, particularly at temperatures between 680°-900° C.

BACKGROUND ART

Most aluminum is produced by the Hall-Heroult process which involves the electrolysis of alumina dissolved in molten cryolite ($Na_3AlF_6$) at about 950°-980° C. using carbon anodes which are consumed with the evolution of $CO/CO_2$. However, the process does suffer from major disadvantages. The high cell temperature is necessary to maintain alumina in solution, but requires heavy expenditure of energy. At the high cell temperature, the electrolyte and the molten aluminum aggressively react with most ceramic materials, and this creates problems of containment and cell design. The anode-cathode distance is critical; and since the anodes are continually being consumed, this creates problems of process control. Further, the back oxidation of Al to $Al^{3+}$ decreases the current efficiency.

Potentially the electrolysis of alumina in $NaF-AlF_3$ melts at "low" temperatures has several distinct advantages over the conventional Hall-Heroult process operating at about 960° C. Most important are higher current and energy efficiencies and the possibility of designing a completely enclosed electrolytic cell.

Problems which hindered the practicability of low temperature electrolysis so far are the low alumina solubilities in low bath ratio electrolytes, as well as low alumina solution rates. Under these conditions, the transport of oxide ion species in the electrolyte to the anode surface can not be maintained at the anode current densities normally used in conventional Hall-Heroult cells. The configuration of such cells and the utilization of consumable carbon anodes do not permit a substantial variation of the relative surface area of anode and cathode.

Low temperature alumina electrolysis has been described in U.S. Pat. No. 3,951,763 and requires numerous expedients such as the use of a special grade of water-containing alumina to protect the carbon anodes, and the bath temperature had to be 40° C. or more above the liquidus temperature of the $Na_3AlF_6/AlF_3$ system in an attempt to avoid crust formation on the cathode. The practical realization of this process, as described in an article "Bench Scale Electrolysis of Alumina in Sodium Fluoride-Aluminum Fluoride Melts Below 900° C." by Sleppy and Cochran (inventors of U.S. Pat. No. 3,951,763) and published in "ALUMINUM" 1979.9 p. 604-606 reveals, however, that the carbon anodes were severely attacked during anode effects accompanied by excessive $CF_4$ emissions. Crusts also formed on the cathode up to electrolyte temperatures of 930° C.

The formation of cryolite crusts on the cathode was caused by depletion of aluminum containing ions at the cathode and a consequent shift in the bath composition at the cathode interface to high NaF content. According to the phase diagram of the $NaF-AlF_3$ system, the decrease in $AlF_3$ content need be only 2% at 860° C. with a bath weight ratio of 0.8 before cryolite will precipitate at the cathode. However, if the same bath is employed at 930° C., 100° C. above the liquidus temperature, the local decrease in $AlF_3$ has to be greater than 7% before cryolite precipitates.

Attempts to reduce the temperature of alumina electrolysis in fluoride baths have thus been unsuccessful. Because of the difficulties encountered with low temperature alumina-containing melts, major efforts to secure the advantages of "low" temperature electrolysis were devoted to using different electrolytes, notably chloride based electrolytes where the anodic reaction is chlorine evolution. See e.g. K. Grjotheim, C. Krohn and H. Oye, Aluminium 51, No. 11, 1975, pages 697-699. However, problems related to the production of pure $AlCl_3$ have hitherto eliminated this process from commercial application.

Another route of producing aluminum in a "low temperature" process was considered by W. E. Haupin in an article published in "Light Metal" Vol 1979, p. 356-661. This method comprises dissolving $Al_2O_3$ in an $LiCl/AlCl_3$ electrolyte, whereby $Al_2O_3$ and $AlCl_3$ form AlOCl which is electrolyzed at approx. 700° C. However, the author reports that the rate of aluminum production is too low for practical commercial application.

OBJECT OF THE INVENTION

It is the object of the invention to provide a method for the production of aluminum by the electrolysis of alumina dissolved in a molten fluoride electrolyte at 680°-900° C. in an aluminum reduction cell under conditions and parameters which allow the economical commercial exploitation of such a method.

The proposed method should, in particular, solve the problems related to low alumina solubility and solution rate in molten cryolite at these low temperatures.

SUMMARY OF THE INVENTION

The above object is met by a method of producing aluminum by electrolysis of alumina dissolved in a molten fluoride electrolyte in an aluminum reduction cell, at a temperature below 900° C., characterized by effecting steady-state electrolysis using an oxygen-evolving anode at an anodic current density which is at or below a threshold value corresponding to the maximum transport rate of oxide ions in the electrolyte and at which oxide ions are discharged preferentially to fluoride ions, the electrolyte circulating between an electrolysis zone wherein the electrolyte is depleted of alumina and an enrichment zone where the electrolyte is enriched with alumina.

The invention is based on the insight that oxide ions in low concentrations, as in the case of low temperature melts, could be discharged efficiently provided the anode current density does not exceed the above threshold current density. Exceeding this value would lead to the discharge of fluoride ions which has been observed in experiments using carbon anodes. In order to carry out a stable electrolysis under the given temperature conditions and the corresponding low solubility of alumina in the low temperature electrolyte the latter is circulated from the electrolysis zone to an enrichment zone and back, to facilitate and eventually speed up the solution rate of alumina.

The temperature of the electrolyte may be in the range of 680° C.-900° C., in particular between 700° C.-750° C.

The above circulation is provided for two purposes, one to prevent blockage of the cathode through buildup of solid $Na_3AlF_6$ at its surface and the other to insure efficient transport of alumina to the anode surface.

The electrolyte may be kept in forced circulation along a predetermined circulation path by appropriate means such as a pump or a stirring mechanism, or it may be circulated by convection. Melt circulation near the inert anode surface could be enhanced by using the effect of oxygen gas lift.

Whatever mode of circulation is provided, the electrolyte may be circulated between the electrolysis zone and the enrichment zone disposed within the same cell compartment or the enrichment zone may be located in a saturator unit separated from the electrolysis zone confined in an electrolysis compartment.

Alumina feed could be either directly into the top of the cell or preferably into the saturator unit through which the alumina-exhausted electrolyte is passed. This unit may operate under such conditions of temperature and hydrodynamic flow that alumina dissolves at an appropriate rate. Generally, to promote the dissolution of alumina, the temperature of the melt in the saturator unit may be higher than the operating temperature in the electrolysis compartment or in the electrolysis zone.

In case of an external electrolyte circulation with increased temperature at the alumina enrichment zone, a heat exchange between the electrolyte leaving and entering the saturator unit may be provided. The heating may be effected by any suitable means such as steam or other.

The electrolyte may comprise a mixture of NaF, LiF and $AlF_3$, the concentration thereof being selected within a range of 0–48 w% NaF, 0–48 w% LiF and 42–63 w% $AlF_3$, so long as NaF or LiF are present with $AlF_3$ the temperature of the electrolyte being in the range of 680°–900° C.

The anodic current density used in the method according to the invention may be up to 5 times lower than the one conventionally employed in Hall-Heroult cells being generally between 0.6 and A/cm$^2$ and the cathodic current density may be kept at conventional levels (0.6–1.2 A/cm$^2$) or lowered likewise. In the first case the ratio between the anodic and cathodic current densities may be as low as 1:5, in the second case both current densities may be essentially equal. Thus the anodic current density can be in the range of 0.1–0.5 A/cm$^2$.

To accommodate for this low anodic current density, the total anode surface must be increased maintaining an equivalent production capacity per unit floor surface. Therefore, the anode must have a special design such as a blade configuration or a porous reticulated structure.

The selection of an anode having low current density characteristics together with a cathode working at normal or also at low current densities requires that such anode be dimensionally stable and of a special configuration which provides an increase of the anode electrochemical surface of at least 1.5 times up to 5 times.

The necessity of using an anode with a special configuration is a major reason for not using a consumable carbon anode in a low temperature electrolytic cell. The anode may be composed of a metal, an alloy, a ceramic or a metal-ceramic composite, stable under the operating conditions. Anode materials which satisfy such requirements are disclosed e.g. in the European Patent Application, Publication No. 0030834 and comprise mixed oxides (ferrite type), or oxyfluorides, or cermets as disclosed in the U.S. Pat. No. 4,397,729.

An electrolytic alumina reduction cell according to the invention may contain a molten fluoride electrolyte with dissolved alumina having a temperature below 900° C., an inert oxygen-evolving anode and a cathode. The anode may have an electrochemically active surface area sufficiently large to allow it to operate with an anodic current density which is at or below a threshold value corresponding to the maximum transport rate of oxide ions in the electrolyte of the above indicated low temperature and at which oxide ions are discharged preferentially to fluoride ions, the electrolyte circulating between an electrolysis zone wherein the electrolyte is depleted of alumina and an enrichment zone where the electrolyte is enriched with alumina.

An alumina reduction cell according to the invention may comprise an electrochemically active surface anode area up to 5 times larger than the projected area of the anode onto a horizontal plane, the surface area of the cathode may be kept at classic values or increased likewise. The latter may e.g. be the case in a cell having a drained cathode configuration whereby the cathode comprises a shape following the surface of the anode in a small distance therefrom.

The enrichment zone of the alumina reduction cell my be embodied by a saturator unit separate from an electrolysis compartment of the cell, and the circulation of the molten electrolyte delivering alumina-depleted electrolyte from the electrolysis compartment to the saturator unit and returning electrolyte enriched with alumina from the saturator unit to the electrolysis compartment may be effected by means providing forced circulation of the molten electrolyte.

The electrolytic cell is preferably totally enclosed and contains no frozen electrolyte. Alumina or any other melt resistant material could advantageously be used as liner for the enclosure.

As mentioned above the total surface of the cathode may be such that the cathodic current density remains at a value comparable with the one in classical Hall-Heroult cells or it may also be decreased. However, there is a limitation as to the decrease of the cathodic current density. This limitation is given by the re-dissolution of the product metal in the electrolyte and its subsequent oxidation at the anode, the dissolution rate being dependent on the cathode (or production metal) surface. The re-dissolution decreases the current efficiency and is therefore a limiting factor for an increase of the cathode surface. This effect is significant in Hall-Heroult cells using an aluminum pad. In a cell using a cathode from which the produced aluminum is constantly drained, however, the dependency of the re-dissolution rate from the cathode surface is less important.

The cathode therefore comprises preferably a configuration which allows continuous draining of the produced metal and it may be composed of a refractory hard metal (RHM) or a composite material thereof which may be disposed either horizontally or vertically.

The RHM material mentioned above may e.g. comprise an oxide, boride or carbide of titanium, zirconium, hafnium, vanadium, niobium or tantalum or a mixture thereof.

The bath composition may be chosen according to several limiting or determining conditions, the most important ones being:

the bath has to be liquid at the chosen operating temperature, the anodic reaction must be oxygen evolution, no undesired cathodic deposition of melt constituents (other than aluminum) must occur, and there must be a finite solubility of $Al_2O_3$ in the melt of at least approx. 1%.

The alumina solubility of some specific compositions within the above range are given in the following table.

| Electrolyte composition in w % | | | Temperature | Solubility of |
|---|---|---|---|---|
| NaF | LiF | $AlF_3$ | (°C.) | Alumina (w %) |
| 27 | 26 | 47 | 695 | 1 |
| 0 | 37 | 63 | 680 | 3 |
| 48 | 9 | 43 | 900 | 5 |
| 0 | 48 | 52 | 900 | 7 |

DESCRIPTION OF PREFERRED EMBODIMENT

Figure 1:
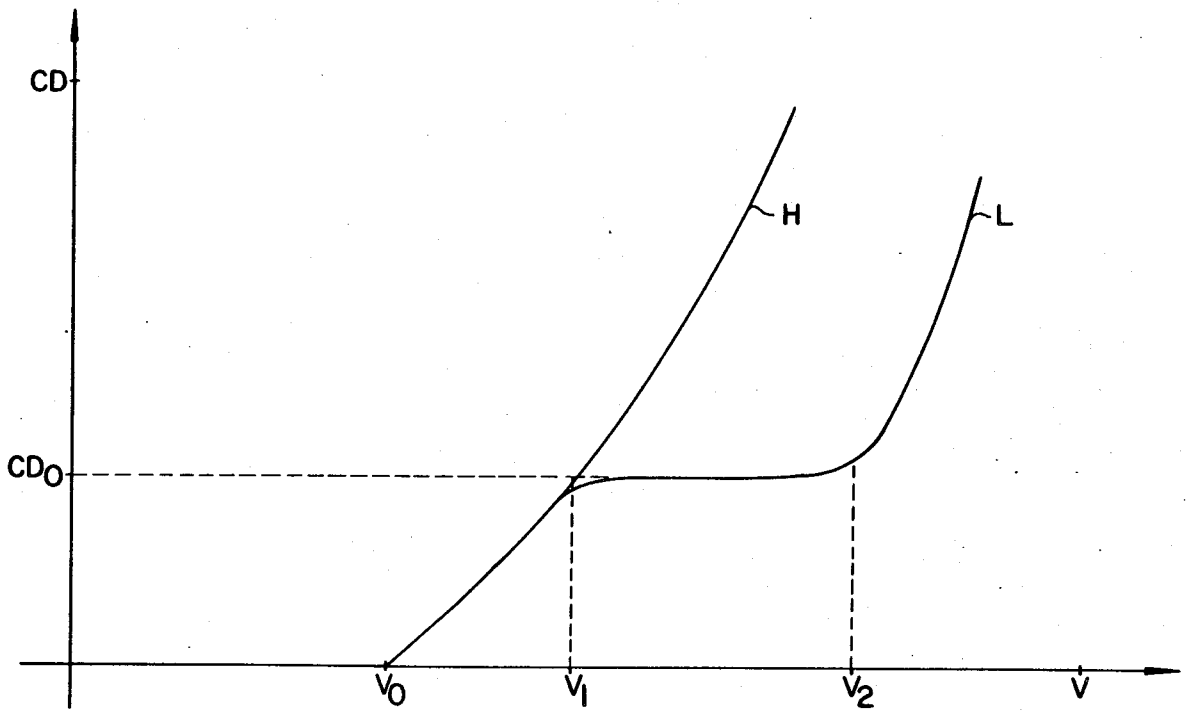
FIG. 1 is a schematic polarization curve in low temperature $Na_3AlF_6.AlF_3$ melts.

With reference to FIG. 1 a schematic polarization curve is illustrated with the voltage V being plotted on the horizontal and the current density CD on the vertical axis.

Curve L stands for "low" temperature and low oxide ion concentration. At zero voltage, no oxide ions are discharged at the anode, even though the transport of ions starts at very small voltages, but the potential is not sufficient to discharge the ions which, therefore, form a concentration barrier near the anode surface which suppresses further transport. At the voltage $V_o$, oxide ions begin to be discharged at the anode; the discharge rate depends on the voltage, increasing rapidly between $V_o$ and $V_1$. At voltages higher than $V_1$ the increase of the oxide ion discharge becomes smaller and shows essentially zero growth between $V_1$ and $V_2$ which is due to the saturation of the oxide ion transport caused by the maximum oxide ion mobility. The current density $CD_o$ in this range, being substantially constant, corresponds to the threshold current density as defined above. The range between $V_1$ and $V_2$ is the optimum operation range for the cell configuration according to the invention. An increase of the voltage beyond $V_2$ causes the discharge of fluoride ions to begin. The diagram shows a second curve H, standing for "high" oxide ion concentration and high temperature. This second curve H shows a slope without a plateau between $V_1$ and $V_2$, since the concentration of oxide ions is high enough and no saturation of the oxide ion transport will be reached in the given range of voltages and current densities.

Figure 2:
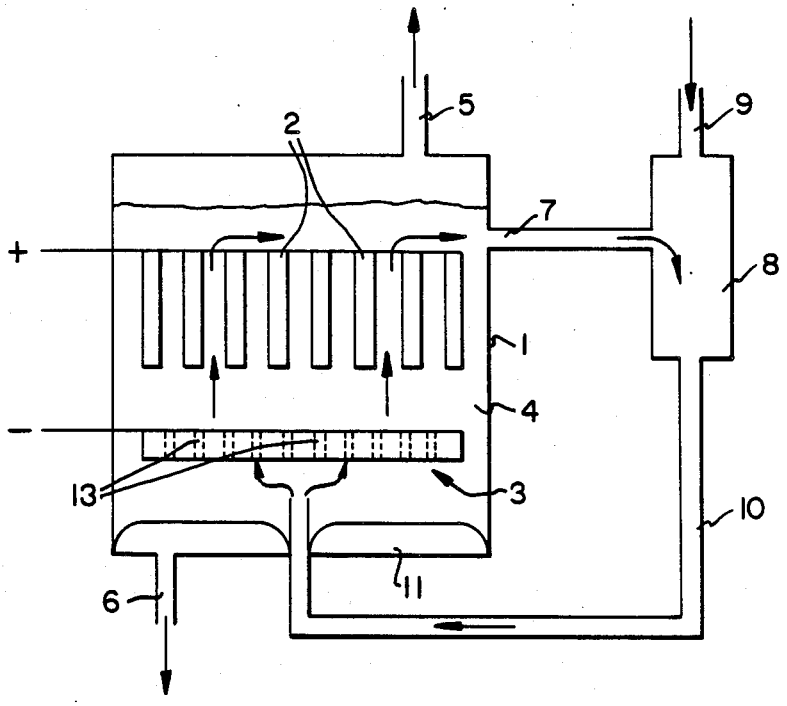
FIG. 2 is a schematic diagram of an enclosed electrolysis cell and recirculation systems.

FIG. 2 shows a schematic cross section of an aluminum production cell adapted to carry out the method according to the invention. The cell comprises an electrolysis compartment 1 including a series of vertically depending blade-like anodes 2 arranged in the upper portion of the compartment 1. A horizontal cathode 3 is provided at the bottom of the compartment 1. The ends of the blade anodes 2 face the cathode 3 and provide the projected area of the anodes onto the horizontal cathode 3. The blade anodes 2 however also have electrochemically active sides of the blades and thus have total electrochemical surface larger than such projected area. The cathode 3 comprises passage holes 13 for the passage of liquid cell contents as described further below. The compartment further comprises several outlets, one outlet 5 at the top of the compartment 1 for oxygen and one, 6 at the bottom for product aluminum. A third outlet 7 located above the anodes 2 serves for the withdrawal of the electrolyte 4 from the compartment 1, this outlet 7 leading to a vessel which, in the following, will be referred to as saturator unit 8, in which the electrolyte is saturated with alumina, advantageously at temperatures higher than the temperature of the electrolyte in the compartment 1. For that purpose, the saturator unit 8 comprises an inlet 9 by which the alumina and possibly other feed or replacement material may be introduced in the saturator unit. A conduit 10 for the saturated electrolyte connects the saturator unit with the bottom of the cell compartment 1, extending a certain distance into the cell compartment as to penetrate a pool 11 of molten product aluminum which has been collected at the cell bottom.

The passage holes 13 in the cathode are provided to permit the passage of the electrolyte 4 which is circulated by means of a pump or by electromotive forces. The electrolyte is circulated so as to enter the compartment 1 at the bottom, penetrate the cathode 3 by its passage holes 13, flow upwards between the anodes 2 and leave the compartment 1 depleted of alumina, by the outlet 7 to be fed into the saturator unit, wherein it is re-saturated with alumina. Aluminum metal which is produced by the electrolysis flows down through the holes 13 of the cathode 3 and is collected at the bottom of the compartment 1, from where it may be withdrawn continuously or batchwise. Oxygen, being the second product of the electrolysis, is released by the outlet 5.

The purpose of the circulation of the electrolyte is to remove the alumina-depleted electrolyte from between the anodes, which otherwise will cause frequent anode effects, as the replenishing of the alumina concentration may not be effective otherwise in these relatively small cross sections between the anodes.

It is to be understood that the illustrated cell is only a schematic sketch and does not limit the scope of the invention to this embodiment. Thus, the cell design may be modified such that the cell comprises only one compartment which contains the electrolysis zone and the enrichment zone, circulation being maintained between these two zones.

It may easily be understood from the illustrated configuration of the cathode and the anodes, that upon passage of a certain current between the anodes and the cathode, the anodic current density is far smaller than the cathodic one, due to the fact that the total surface of the anodes is larger than that of the cathode. Thus, the concept of reducing the anodic current density is realized by the cell according to FIG. 2 in a manner to maintain the production rate of aluminum per unit floor surface at the classic level, since the cathodic current density is the same as in a Hall-Heroult cell.

The principle of operating an aluminum cell at low anodic current density may alternatively be realized by simply reducing the current between anode and cathode, however, the production rate of such a cell would be decreased accordingly. The cell according to FIG. 2 maintains the overall current and increases the anode surface, thus maintaining the economic conditions of a classic aluminum cell.

The feasibility of the invention was demonstrated in the following laboratory examples.

EXAMPLE I

An experiment was conducted in a laboratory scale electrolytic cell composed of an all alumina crucible, a $TiB_2$ disc disposed at the bottom of the crucible and acting as a cathode, and a copper sheet anode with the dimensions 52×54×1 mm.

About 800 g of electrolyte of the following composition in weight percent (61% $Na_3AlF_6$, 35% $AlF_3$, 4%, $Al_2O_3$) was used, whereby the alumina was not entirely dissolved. Stirring and circulation of the melt was obtained by bubbling argon gas near the cathode surface. The temperature was 780° C., and the anode and cathode current densities, 0.1 and 1.1 A/cm$^2$, respectively. Cell voltage was 4.8 V. The electrolysis was maintained for 24 hours with no apparent difficulty. After 17 hours running, 60 g of alumina were introduced as feed. The current efficiency was 85%. (Higher current efficiencies are to be expected in larger cells.)

EXAMPLE II

The experiment of Example I was repeated at a temperature of 760° C. and for a duration of 30 hours. The anode and cathode current densities were 0.1 and 0.9 A/cm$^2$ respectively. The cell voltage was 3.2 V and the current efficiency was 81%.

What is claimed is:

1. A method of producing aluminum by electrolysis of alumina dissolved in a molten fluoride electrolyte in an aluminum reduction cell using a low temperature melt, at a temperature up to 860° C., characterized by effecting a continuing steady-state electrolysis using an oxygen-evolving, non-consumable anode having an electrochemically active surface area at least 1.5 times larger than the projected area of the anode onto a horizontal plane, said electrolysis being effected at an anodic current density which is at or below a threshold value corresponding to the maximum transport rate of oxide ions in the electrolyte and at which oxide ions are discharged preferentially to fluoride ions, the electrolyte circulating between an electrolysis zone wherein the electrolyte is depleted of alumina and an enrichment zone wherein the electrolyte is enriched with alumina.

2. The method of claim 1, characterized by the temperature of the electrolyte being between 700° C. and 750° C.

3. The method of claim 1, characterized by a forced circulation of the molten electrolyte in the cell.

4. The method of claim 3, characterized by alumina depleted electrolyte being removed from an electrolysis compartment of the cell, enriched with alumina in an external saturator unit and recycled to the electrolysis compartment.

5. The method of claim 4, characterized by enrichment of the electrolyte with alumina outside the electrolysis compartment at a temperature higher than the temperature in the electrolysis compartment.

6. The method of claim 1, characterized by the electrolyte comprising a mixture that can include NaF, LiF and $AlF_3$, the concentration thereof being selected within a range of 0–48 w% NaF, 0–48 w% LiF and 42–63 w% $AlF_3$, with the proviso that NaF, or LiF or their mixtures are present with $AlF_3$, the temperature of the electrolyte being in the range of 680°–860° C.

7. The method of claim 1, characterized by the anodic current density being in the range 0.1–0.5 A/cm$^2$.

8. The method of claim 1, characterized by the ratio of the anodic to cathodic current densities being between 1:1 and 1:11.

9. An electrolytic alumina reduction cell containing a molten fluoride electrolyte with dissolved alumina in a low temperature melt at a temperature up to 860° C., with the cell having an anode and a cathode, characterized by having a non-consumable, oxygen evolving anode comprising a total electrochemical surface which is at least 1.5 times larger than the projected area of the anode onto a horizontal plane, and with there being a circulation path for cell electrolyte including an electrolysis zone wherein the electrolyte is depleted of alumina and an enrichment zone where the electrolyte is enriched with alumina.

10. The alumina reduction cell of claim 9, characterized by the temperature of the electrolyte being between 680° C. and 860° C. and the anodic current density being in the range 0.1–0.5 A/cm$^2$.

11. The alumina reduction cell of claim 10, characterized by the temperature of the electrolyte being between 700° C. and 750° C. and the solubility of $Al_2O_3$ in the melt being at least about one w%.

12. The alumina reduction cell of claim 9, characterized by the electrochemically active surface area of the anode being 1.5–5 times larger than the projected area of the anode onto a horizontal plane.

13. The alumina reduction cell of claim 9, characterized by comprising a saturator unit separated from an electrolysis compartment and means for delivering alumina-depleted electrolyte from the electrolysis compartment to the saturator unit and returning electrolyte enriched with alumina from the saturator unit to the electrolysis compartment.

14. The alumina reduction cell of claim 9, characterized by the oxygen-evolving anode being composed of a metal alloy, ceramic or metal-ceramic composite stable under the operating conditions.

15. The alumina reduction cell of claim 9, characterized by the cathode being composed of a material comprising at least one refractory hard metal selected from the group consisting of borides, nitrides, carbides and oxides of titanium, zirconium, hafnium, vanadium, niobium and tantalum.

16. The method for the electrolytic reduction of alumina contained in a molten fluoride electrolyte, which method comprises;

establishing an electrolyte containing at least approximately one weight percent dissolved alumina;

maintaining said electrolyte as a low temperature melt at a temperature up to 860° C.;

providing a non-consumable, oxygen-evolving anode for the electrolysis;

establishing an anodic current density at or below a threshold value corresponding to the maximum transport rate of oxide ions in said electrolyte, and at which oxide ions are discharged preferentially to fluoride ions, while maintaining a ratio of the anodic to cathodic current density of between 1:1.2 and 1:11, and providing means for alumina enrichment of said cell electrolyte.

17. The method of claim 16, wherein the cathodic current density is maintained above about 0.6 A/cm$^2$ while the anodic current density is not above about 0.5 A/cm$^2$.

18. An electrolytic alumina reduction cell containing a molten fluoride electrolyte containing at least one weight percent dissolved alumina in a low temperature melt at a temperature up to 860° C., the cell having at least one cathode as well as a non-consumable, oxygen-evolving anode, said cell having an anodic current density at or below a threshold value corresponding to the maximum transport rate of oxide ions in said electrolyte and at which oxide ions are discharged preferentially to fluoride ions, and with the electrochemically active surface area of the anode being 1.5–5 times larger than the projected area of the anode onto a horizontal plane.

19. The cell of claim 18, wherein the temperature of the electrolyte is between 680°–860° C. and the ratio of the anodic to cathodic current density for the cell is between 1:1.2 and 1:11.

20. The cell of claim 18, wherein the anodic current density is not above about 0.5 $A/cm^2$ and said cell includes means for alumina enrichment of cell electrolyte.

* * * * *